US009528317B2

(12) United States Patent
Nam et al.

(10) Patent No.: US 9,528,317 B2
(45) Date of Patent: Dec. 27, 2016

(54) SLIDING WINDOW HAVING CLEANING UNIT

(71) Applicant: LG HAUSYS, LTD., Seoul (KR)

(72) Inventors: Bo Ra Nam, Cheongju-si (KR); Chang Hyeon Ji, Cheongju-si (KR)

(73) Assignee: LG HAUSYS, Ltd., Seoul (KR)

( * ) Notice: Subject to any disclaimer, the term of this patent is extended or adjusted under 35 U.S.C. 154(b) by 0 days.

(21) Appl. No.: 14/361,553

(22) PCT Filed: Nov. 29, 2012

(86) PCT No.: PCT/KR2012/010234
§ 371 (c)(1),
(2) Date: May 29, 2014

(87) PCT Pub. No.: WO2013/081394
PCT Pub. Date: Jun. 6, 2013

(65) Prior Publication Data

US 2014/0318015 A1 Oct. 30, 2014

(30) Foreign Application Priority Data

Dec. 1, 2011 (KR) ..... 10-2011-0127446

(51) Int. Cl.
*E06B 7/00* (2006.01)
*E06B 7/28* (2006.01)
(Continued)

(52) U.S. Cl.
CPC ..... *E06B 7/00* (2013.01); *B08B 3/022* (2013.01); *E06B 7/28* (2013.01); *E06B 3/4609* (2013.01)

(58) Field of Classification Search
CPC ..... B08B 3/02; B08B 3/022; E06B 7/00; E06B 7/28
See application file for complete search history.

(56) References Cited

U.S. PATENT DOCUMENTS 1,030,546 A * 6/1912 Sharkey ..... 15/250.1
1,045,345 A * 11/1912 Wetherell ..... 15/250.1
(Continued)

FOREIGN PATENT DOCUMENTS

EP 0047344 A1 3/1982
KR 2003902620000 Y1 7/2005
(Continued)

*Primary Examiner* — Brian Mattei
*Assistant Examiner* — Catherine A Kelly
(74) *Attorney, Agent, or Firm* — Dentons US LLP

(57) ABSTRACT

Disclosed therein is a sliding window having a cleaning unit. The sliding window includes: window panes having an inside window pane and an outside window pane; a window frame on which the window panes are mounted in a slidable manner; a vermin screen mounted at an outdoor side of the outside window pane; and a cleaning unit vertically mounted on a fixing side MC (Middle Closing) of the outside window pane or a screen side MC of the vermin screen in a longitudinal direction, wherein in the case that the cleaning unit is mounted at the fixing side MC of the outside window pane, the cleaning unit cleans the outside of the inside window pane while the inside window pane slides, and in the case that the cleaning unit is mounted at the screen side MC of the vermin screen, the cleaning unit cleans the outside of the outside window pane while the outside window pane slides.

3 Claims, 5 Drawing Sheets

(51) Int. Cl.
*B08B 3/02* (2006.01)
*E06B 3/46* (2006.01)

(56) References Cited

U.S. PATENT DOCUMENTS

| | | | | | |
|---|---|---|---|---|---|
| 3,048,871 | A | * | 8/1962 | Presser | 15/250.19 |
| 3,434,882 | A | * | 3/1969 | Lyn | 134/26 |
| 3,513,499 | A | * | 5/1970 | Keith et al. | 15/250.01 |
| 3,548,440 | A | * | 12/1970 | Kothari | 15/250.01 |
| 3,548,441 | A | * | 12/1970 | Kruger | 15/250.01 |
| 3,686,705 | A | * | 8/1972 | Parker et al. | 15/250.01 |
| 5,339,488 | A | * | 8/1994 | Maass | 15/250.01 |
| 5,406,966 | A | * | 4/1995 | Lepkowski | 134/104.4 |
| 6,358,138 | B1 | * | 3/2002 | Alder | 454/124 |

FOREIGN PATENT DOCUMENTS

| | | | |
|---|---|---|---|
| KR | 1020090020313 | A | 2/2009 |
| KR | 1020090067983 | A | 6/2009 |
| KR | 1020100118924 | A | 11/2010 |
| KR | 2020110007413 | U | 7/2011 |

* cited by examiner

SLIDING WINDOW HAVING CLEANING UNIT

This application is a National Stage Entry of International Application No. PCT/KR2012/010234, filed on Nov. 29, 2012, and claims the benefit of Korean Application No. 10-2011-0127446, filed on Dec. 1, 2011, which are hereby incorporated by reference in its entirety for all purposes as if fully set forth herein.

TECHNICAL FIELD

The present invention relates to a sliding window having a cleaning unit which can clean the outside of a window of a high-rise building, and more particularly, to a sliding window having a cleaning unit, which has a cleaning unit mounted at a middle closing (MC) of a fixed side of an outside window pane or a middle closing (MC) of a vermin screen to thereby clean the outside window just by sliding the window pane.

BACKGROUND ART

In general, buildings respectively have various kinds of windows or doors which are installed on openings of the buildings in order to block out the inside of the building from the outside, and in this instance, frames for supporting the windows or doors are classified into a wooden frame and a metal frame according to used materials. However, recently, the frames for windows or doors are made of plastic or synthetic resin such as PVC.

Now, the process of opening and closing a conventional sliding window will be described. When a user slides the window in a direction that the window is closed in a state where the user grasps a hand-grip of the window, rollers mounted on a lower end portion of the window rotate along a rail on a window frame. Accordingly, the window pane gradually approaches the window frame of the opposite side, and finally, stops by touching the window frame, so that the closing action of the window is finished.

However, the conventional sliding window having the window frame and the window pane has a problem in that it is difficult to clean the outside of the window pane for safety reasons in the case of high-rise apartments.

Moreover, in order to solve the above problem, various attempts have been made, but, even though a cleaning device is installed on the window, it causes several problems in that the external appearance is unbeautiful, the entire window becomes thicker, and an opening and closing rate of a ventilation window is deteriorated.

DISCLOSURE OF INVENTION

Technical Problem

Accordingly, the present invention has been made in an effort to solve the above-mentioned problems occurring in the prior arts, and it is an object of the present invention to provide a sliding window having a cleaning unit, which is easy to clean the outside of a window pane, provides a beautiful external appearance, does not make the entire thickness of the window become thicker, and prevents deterioration in opening and closing rate of a ventilation window.

Solution to Problem

To achieve the above objects, the present invention provides a sliding window having a cleaning unit including:

window panes having an inside window pane and an outside window pane; a window frame on which the window panes are mounted in a slidable manner; a vermin screen mounted at an outdoor side of the outside window pane; and a cleaning unit vertically mounted on a fixing side MC (Middle Closing) of the outside window pane or a screen side MC of the vermin screen in a longitudinal direction, wherein in the case that the cleaning unit is mounted at the fixing side MC of the outside window pane, the cleaning unit cleans the outside of the inside window pane while the inside window pane slides, and in the case that the cleaning unit is mounted at the screen side MC of the vermin screen, the cleaning unit cleans the outside of the outside window pane while the outside window pane slides.

The cleaning unit includes: a cleaning frame joined to the fixing side MC of the outside window pane or the MC of the vermin screen; a water supply nozzle disposed at the cleaning frame to allow inflow of cleaning water from the outside; a cleaning water passage connected to the water supply nozzle and arranged inside the cleaning frame; at least one cleaning water injection nozzle connected to the cleaning water passage and mounted on the cleaning frame to spray the cleaning water toward the surface of an object to be cleaned; and a cleaning blade protruding from the cleaning frame and facing the object to be cleaned.

The cleaning unit further includes: a blade support member rotatably joined to one side of the cleaning frame in a longitudinal direction; and a blade rotating lever having an end portion protrudingly formed at one side of the cleaning frame and the other end portion connected to the blade support member, wherein an end portion of one side of the cleaning blade is joined to one side of the blade support member to operate the blade rotating lever, and an end portion of the other side of the cleaning blade gets in contact with the surface of the object to be cleaned or is released from the contact state while the cleaning blade rotates.

The cleaning unit further includes: a reservoir tank which is connected to the cleaning water passage and stores cleaning water therein; and a water supply pump which is connected to the reservoir tank and sprays the cleaning water through the cleaning water injection nozzle.

The cleaning unit further includes: upper and lower caps respectively joined to upper and lower ends of the cleaning frame, wherein the upper cap has a cleaning water spray hole so that the cleaning water supplied from the cleaning water passage runs down.

In another aspect of the present invention, the present invention provides a sliding window having a cleaning unit including: window panes having an inside window pane and an outside window pane; a window frame on which the window panes are mounted in a slidable manner; and a cleaning unit vertically mounted on a fixing side MC (Middle Closing) of the outside window pane in a longitudinal direction, wherein the cleaning unit cleans the outside of the inside window pane while the inside window pane slides.

Advantageous Effects of Invention

The sliding window having a cleaning unit according to the present invention is easy to clean the outside of a window pane, provides a beautiful external appearance, does not make the entire thickness of the window become thicker, and prevents deterioration in opening and closing rate of a ventilation window.

Moreover, the sliding window having a cleaning unit according to the present invention includes the rotatable blade support member mounted at one side of the cleaning frame and the blade rotating lever connected to the blade support member. Accordingly, the cleaning unit according to the present invention can minimize abrasion of the cleaning blade because it separates the cleaning blade from the surface of an object to be cleaned by rotating the cleaning blade when it is not used.

Furthermore, the cleaning unit according to the present invention includes the reservoir tank for storing cleaning water therein and the water supply pump connected to the reservoir tank for spraying the cleaning water through the cleaning water injection nozzle. Accordingly, the sliding window having the cleaning unit can enhance convenience in cleaning by spraying the cleaning water when the water supply pump is operated.

MODE FOR THE INVENTION

Figure 1:
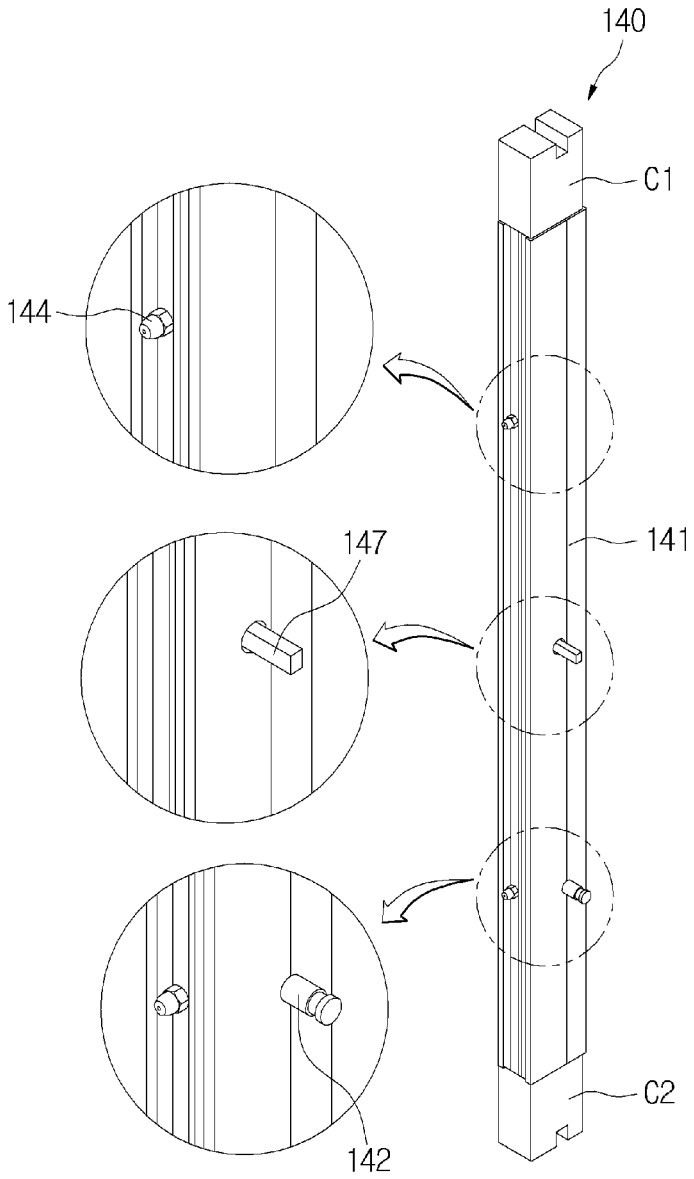
FIG. 1 is a perspective view schematically showing a cleaning unit according to a preferred embodiment of the present invention.

Reference will be now made in detail to the preferred embodiment of the present invention with reference to the attached drawings.

The features, advantages and solutions of the present invention will be apparent from the following detailed description of the preferred embodiments of the invention in conjunction with the accompanying drawings.

The present invention is not restricted to the embodiments of the present invention but can be embodied in other various forms. The embodiments of the present invention are provided in order to completely disclose the present invention and perfectly let those skilled in the art know the scope of the invention, and hence, the present invention is defined by the scope of claims.

In the drawings, the same components have the same reference numerals.

Hereinafter, referring to the drawings of a sliding window having a cleaning unit according to a preferred embodiment of the present invention, the present invention will be described.

Figure 2:
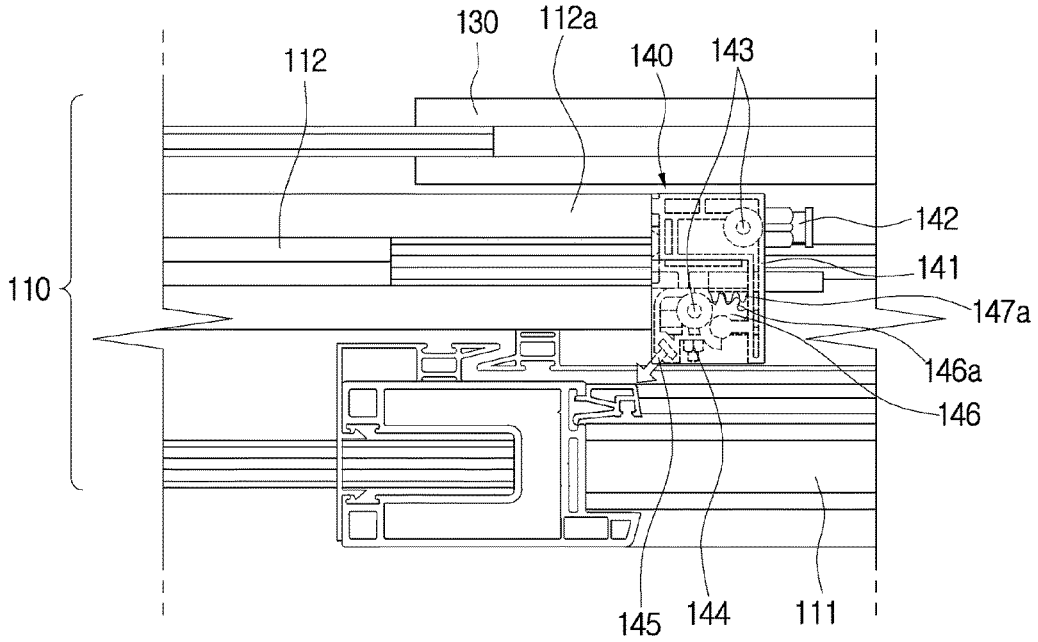
FIG. 2 is a plan view showing that the cleaning unit according to the present invention is joined to a middle closing (MC) of a fixing side of an outside window pane.
Figure 3:
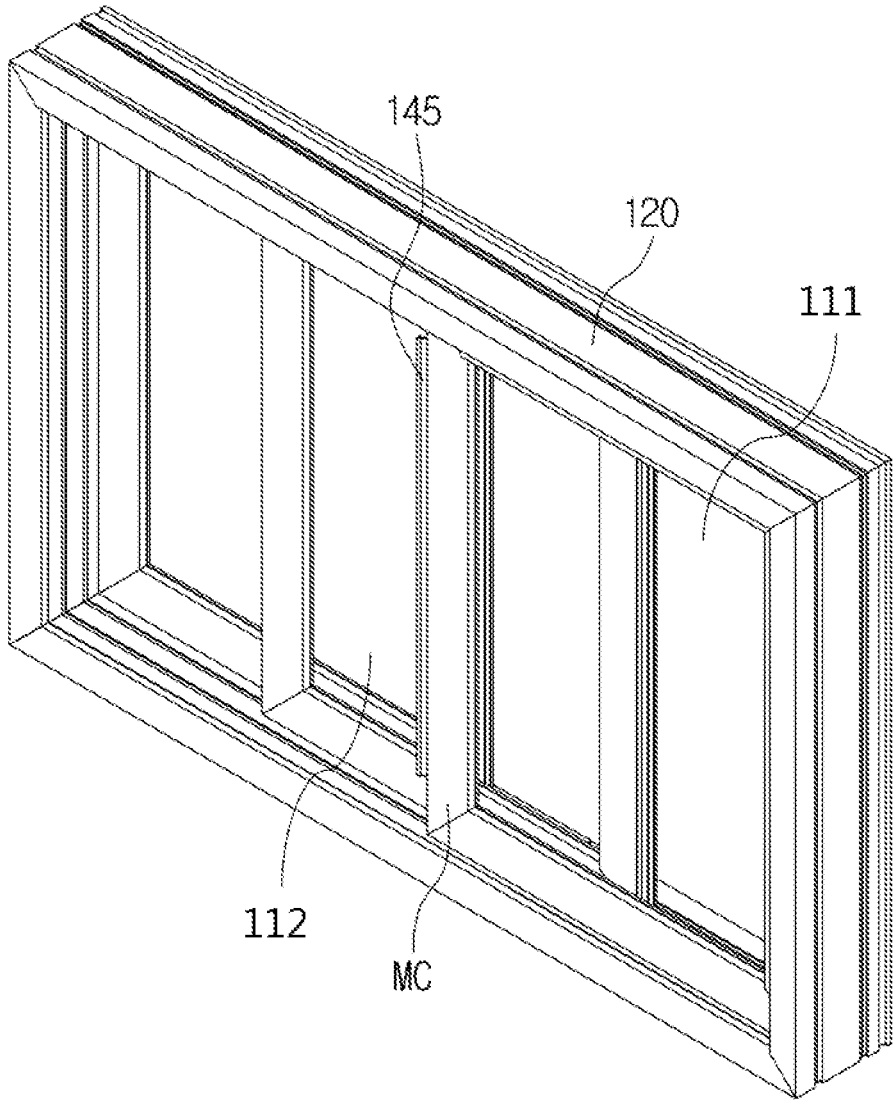
FIG. 3 is a perspective view showing an MC part where the cleaning unit is mounted.

FIG. 1 is a perspective view schematically showing a cleaning unit according to a preferred embodiment of the present invention, FIG. 2 is a plan view showing that the cleaning unit according to the present invention is joined to a middle closing (hereinafter, called 'MC') of a fixing side of an outside window pane, FIG. 3 is a perspective view showing an MC part where the cleaning unit is mounted', and FIG. 3 is a plan view showing that the cleaning unit according to the present invention is joined to an MC of a vermin screen.

Referring to FIGS. 1 and 3, the sliding window having the cleaning unit according to the preferred embodiment of the present invention can clean the outside window of an inside window pane 111 or an outside window pane 112 just by having a cleaning unit 140 that is mounted on a fixing side middle closing (hereinafter, called 'MC') 112*a* of an outside window pane 112 or a screen side MC 130*a* of a vermin screen 130 and by sliding the inside window pane 111 or the outside window pane 112.

In more detail, the sliding window having the cleaning unit according to the present invention includes: window panes 110 having an inside window pane 111 and an outside window pane 112; a window frame 120 on which the windows are mounted in a slidable manner; a vermin screen 130 mounted at an outdoor side of the outside window pane 112; and a cleaning unit 140 vertically mounted on a fixing side MC 112*a* of the outside window pane 112 or a screen side MC 130*a* of the vermin screen 130 in a longitudinal direction. In the case that the cleaning unit 140 is mounted at the fixing side MC 112*a* of the outside window pane 112, the cleaning unit 140 cleans the outside of the inside window pane 111 while the inside window pane 11 slides (See FIG. 2). Alternatively, in the case that the cleaning unit 140 is mounted at the screen side MC 130*a* of the vermin screen 130, the cleaning unit 140 cleans the outside of the outside window pane 112 while the outside window pane 112 slides (See FIG. 4).

Furthermore, In the above description, the MC (Middle Closing) of the fixing side MC 112*a* of the outside window pane 112 or the screen side MC 130*a* of the vermin screen 130 means a window pane frame (MC in the drawings) of the overlapped portion at the central portion of a pair of the window panes, as shown in FIG. 3, in a state where right and left sliding window panes are closed.

Here, in the sliding window having the cleaning unit according to the present invention, the cleaning unit 140 includes: a cleaning frame 141 joined to the fixing side MC 112*a* of the outside window pane 112 or the MC 130*a* of the vermin screen 130; a water supply nozzle 142 disposed at the cleaning frame 141 to allow inflow of cleaning water from the outside; a cleaning water passage 143 connected to the water supply nozzle 142 and arranged inside the cleaning frame 141; at least one cleaning water injection nozzle 144 connected to the cleaning water passage 143 and mounted on the cleaning frame 141 to spray the cleaning water toward the surface of an object to be cleaned; and a cleaning blade 145 protruding from the cleaning frame 141 and facing the object to be cleaned.

Additionally, the cleaning unit 140 further includes: a blade support member 146 rotatably joined to one side of the cleaning frame 141 in a longitudinal direction; and a blade rotating lever 147 having an end portion protrudingly formed at one side of the cleaning frame 141 and the other end portion connected to the blade support member 146, wherein an end portion of one side of the cleaning blade 145 is joined to one side of the blade support member 146 to operate the blade rotating lever 147, and an end portion of the other side of the cleaning blade 145 gets in contact with the surface of the object to be cleaned or is released from the contact state while the cleaning blade 145 rotates.

Accordingly, in the cleaning unit 140 which further includes the blade support member 146 and the blade rotating lever 147, when the blade rotating lever 147 is pressed or rotated, the cleaning blade 145 which is usually separated from the surface of the object to be cleaned is rotated, and then, one end portion of the cleaning blade 145 gets in contact with the surface of the object to be cleaned, so that the outside of the inside window pane 111 is cleaned when the inside window pane 111 slides and the outside of the outside window pane 112 is cleaned when the outside window pane 112 slides. When the cleaning unit 140 is not used, the cleaning blade 145 is separated from the surface of the object to be cleaned to thereby prevent abrasion of the cleaning blade 145.

Figure 5:
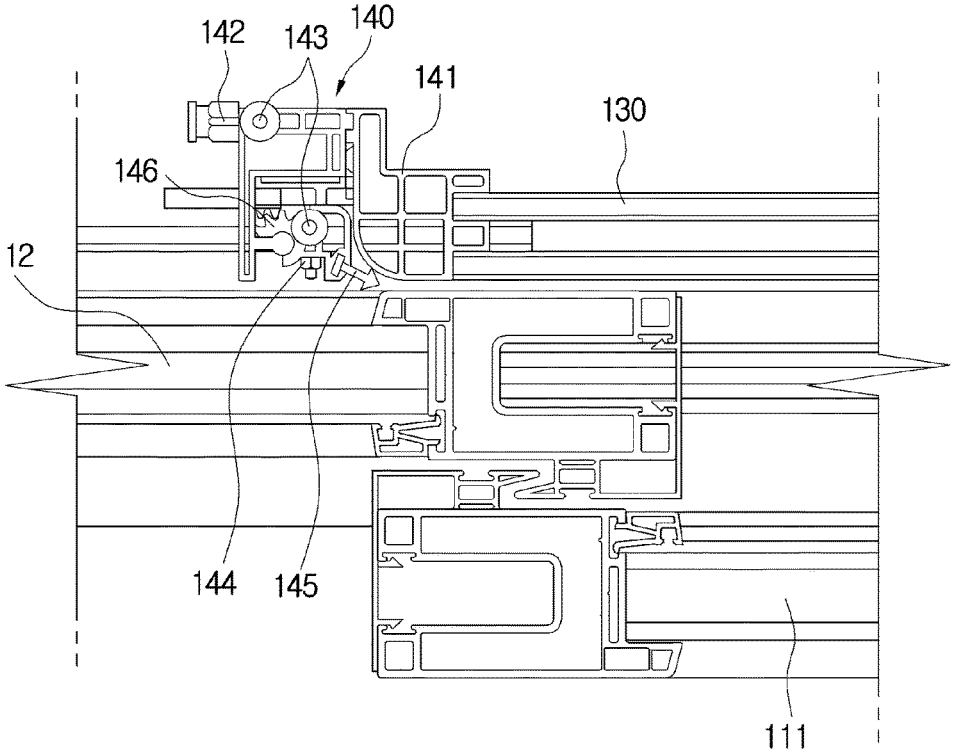
FIG. 5 is a plan view showing that the cleaning unit of FIG. 4 is released from a contact state by a cleaning blade separated from the surface of a window pane to be cleaned.

In more detail, as shown in FIG. 5, when the blade rotating lever 147 is rotated, a screw thread 146*a* of the blade support member 146 engages with another screw thread 147*a* which is formed on the outer circumference of an end portion of the blade rotating lever 147, so that the blade support member 146 is rotated.

Figure 4:
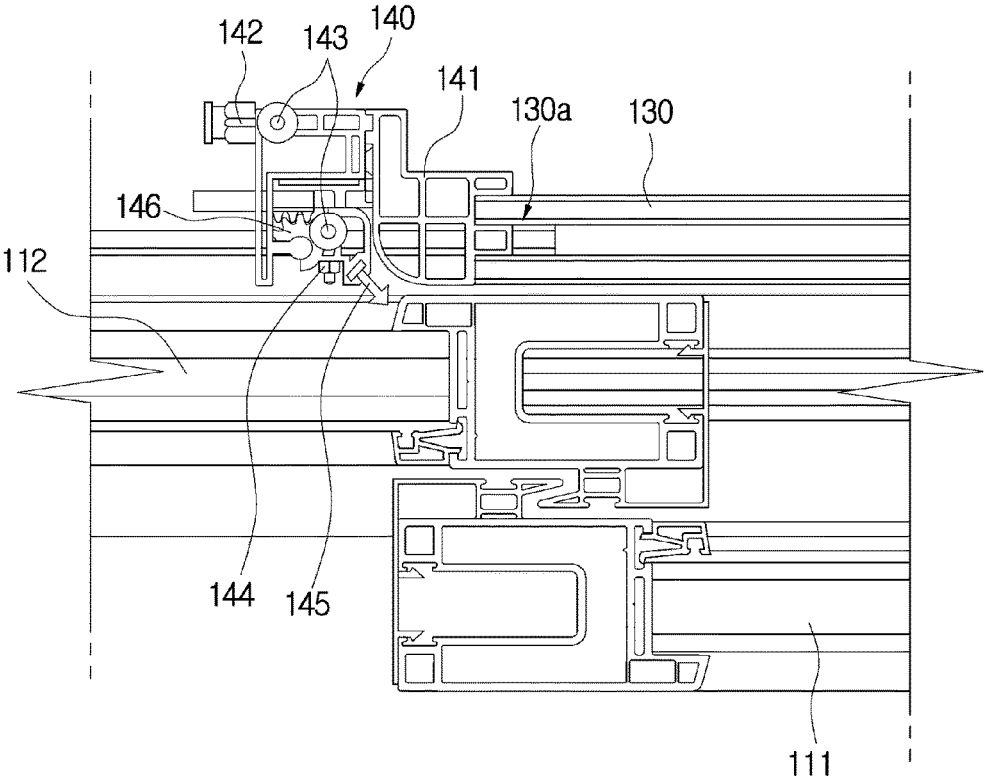
FIG. 4 is a plan view showing that the cleaning unit according to the present invention is joined to a middle closing (MC) of a vermin screen.

Accordingly, as described above, when the blade support member 146 is rotated, an end portion of the cleaning blade 145 whose the other end portion is joined to the blade support member 146 is rotated as much as a set angle, and the cleaning blade 145 is separated from the surface of the window pane to be cleaned, so that the contact state shown in FIG. 4 is released.

Moreover, whenever a user wants to clean the window, a water supply hose may be connected to the water supply nozzle 142 in such a fashion that cleaning water is sprayed from the cleaning water injection nozzle 144. However, it is preferable that the cleaning unit 140 further includes: a reservoir tank (not shown) which is connected to the cleaning water passage 143 and stores cleaning water therein; and a water supply pump (not shown) which is connected to the reservoir tank and sprays the cleaning water through at least one cleaning water injection nozzle 144, so that the cleaning unit 140 sprays the cleaning water by operating the water supply pump to thereby enhance convenience in cleaning.

Furthermore, as shown in FIG. 1, the cleaning unit 140 further includes upper and lower caps C1 and C2 respectively joined to upper and lower ends of the cleaning frame 141, wherein the upper cap C1 has a cleaning water spray hole (not shown) so that the cleaning water supplied from the cleaning water passage 143 runs down.

While the present invention has been particularly shown and described with reference to the example embodiments thereof, it will be understood by those of ordinary skill in the art that various changes in form and details may be made therein without changing the technical idea or essential characteristics of the present invention as defined by the following claims.

Therefore, it would be understood that the above embodiments of the present invention are all exemplified and the present invention is not restricted to the above embodiments.

Accordingly, it should be understood that there is no intent to limit example embodiments of the invention to the particular forms disclosed, but on the contrary, example embodiments of the invention are to cover all modifications, equivalents, and alternatives falling within the scope of the invention without departing from the spirit and scope of the present invention as defined by the following claims.

EXPLANATION OF ESSENTIAL REFERENCE NUMERALS IN DRAWINGS

110: window pane
111: inside window pane
120: window frame
130: vermin screen
130*a*: screen side
MC 140: cleaning unit
141: cleaning frame
142: water supply nozzle
143: cleaning water passage
144: cleaning water supply nozzle
145: cleaning blade
146: blade support member
146*a*: screw thread of the blade support member
147: blade rotating leer
147*a*: screw thread of the blade rotating lever
C1: upper cap
C2: lower cap
MC: middle closing

The invention claimed is:

1. A sliding window having a cleaning unit comprising:
window panes having an inside window pane and an outside window pane;
a window frame on which the window panes are mounted in a slidable manner;
a vermin screen mounted at an outdoor side of the outside window pane; and
a cleaning unit vertically mounted on a fixing side MC (Middle Closing) of the outside window pane or a screen side MC of the vermin screen in a longitudinal direction, wherein in the case that the cleaning unit is mounted at the fixing side MC of the outside window pane, the cleaning unit cleans the outside of the inside window pane while the inside window pane slides, or in the case that the cleaning unit is mounted at the screen side MC of the vermin screen, the cleaning unit cleans the outside of the outside window pane while the outside window pane slides,
wherein the cleaning unit comprises:
a cleaning frame joined to the fixing side MC of the outside window pane or the MC of the vermin screen;
a water supply nozzle disposed at the cleaning frame to allow inflow of cleaning water from the outside;
a cleaning water passage connected to the water supply nozzle and arranged inside the cleaning frame;
at least one cleaning water injection nozzle connected to the cleaning water passage and mounted on the cleaning frame to spray the cleaning water toward the surface of an object to be cleaned;
a cleaning blade protruding from the cleaning frame and facing the object to be cleaned;
a blade support member rotatably joined to one side of the cleaning frame in a longitudinal direction; and
a blade rotating lever having an end portion protrudingly formed at one side of the cleaning frame and the other end portion connected to the blade support member,
wherein an end portion of one side of the cleaning blade is joined to one side of the blade support member to operate the blade rotating lever, and an end portion of the other side of the cleaning blade gets in contact with the surface of the object to be cleaned or is released from the contact state while the cleaning blade rotates, and
wherein when the blade rotating lever is rotated, a screw thread of the blade support member engages with another screw thread which is formed on the outer circumference of an end portion of the blade rotating lever, so that the blade support member is rotated.

2. The sliding window according to claim 1, wherein the cleaning unit further comprises:
upper and lower caps respectively joined to upper and lower ends of the cleaning frame.

3. A sliding window having a cleaning unit comprising:
window panes having an inside window pane and an outside window pane;
a window frame on which the window panes are mounted in a slidable manner; and a cleaning unit vertically mounted on a fixing side MC (Middle Closing) of the outside window pane in a longitudinal direction, wherein the cleaning unit cleans the outside of the inside window pane while the inside window pane slides, and wherein the cleaning unit comprises:

a cleaning frame joined to the fixing side MC of the outside window pane or the MC of the vermin screen;

a water supply nozzle disposed at the cleaning frame to allow inflow of cleaning water from the outside;

a cleaning water passage connected to the water supply nozzle and arranged inside the cleaning frame;

at least one cleaning water injection nozzle connected to the cleaning water passage and mounted on the cleaning frame to spray the cleaning water toward the surface of an object to be cleaned;

a cleaning blade protruding from the cleaning frame and facing the object to be cleaned;

a blade support member rotatably joined to one side of the cleaning frame in a longitudinal direction; and a blade rotating lever having an end portion protrudingly formed at one side of the cleaning frame and the other end portion connected to the blade support member, wherein an end portion of one side of the cleaning blade is joined to one side of the blade support member to operate the blade rotating lever, and an end portion of the other side of the cleaning blade gets in contact with the surface of the object to be cleaned or is released from the contact state while the cleaning blade rotates, and wherein when the blade rotating lever is rotated, a screw thread of the blade support member engages with another screw thread which is formed on the outer circumference of an end portion of the blade rotating lever, so that the blade support member is rotated.

* * * * *